US007316879B2

(12) United States Patent
Nakamura et al.

(10) Patent No.: US 7,316,879 B2
(45) Date of Patent: Jan. 8, 2008

(54) IMAGING COLOR TONER, COLOR IMAGE FORMING METHOD AND COLOR IMAGE FORMING APPARATUS

(75) Inventors: Yasushige Nakamura, Kawasaki (JP); Shinichi Yaoi, Kawasaki (JP); Tomoaki Tanaka, Kawasaki (JP); Yoshimichi Katagiri, Kawasaki (JP)

(73) Assignee: Fuji Xerox Co., Ltd., Minato-ku (JP)

( * ) Notice: Subject to any disclaimer, the term of this patent is extended or adjusted under 35 U.S.C. 154(b) by 0 days.

(21) Appl. No.: 09/935,668

(22) Filed: Aug. 24, 2001

(65) Prior Publication Data

US 2003/0049553 A1 Mar. 13, 2003

(30) Foreign Application Priority Data

Mar. 30, 2001 (JP) ..... 2001-101159

(51) Int. Cl.
*G03G 9/087* (2006.01)

(52) U.S. Cl. ..... 430/108.21; 430/108.1; 430/108.2; 430/108.6; 430/109.4; 430/123.55; 430/124.4; 399/252; 399/336

(58) Field of Classification Search ..... 430/97, 430/124, 109.4, 108.1, 108.2, 108.21, 108.6, 430/124.1, 123.55, 124.4; 399/252, 336, 399/335

See application file for complete search history.

(56) References Cited

U.S. PATENT DOCUMENTS 4,299,899 A 11/1981 Azar et al.
4,539,284 A 9/1985 Barbetta et al.
4,699,863 A 10/1987 Sawatari et al.
4,788,123 A 11/1988 Berkes et al.
4,863,824 A * 9/1989 Uchida et al. ..... 430/109.4
4,863,825 A 9/1989 Yoshimoto et al.
4,917,983 A 4/1990 Uchida et al.
5,330,870 A 7/1994 Tanaka et al.
5,432,035 A 7/1995 Katagiri et al.
5,501,931 A 3/1996 Hirama et al.
5,618,648 A 4/1997 Horikoshi et al.
5,652,075 A 7/1997 Kanbayashi et al.

(Continued)

FOREIGN PATENT DOCUMENTS

EP 0 491 086 6/1992

(Continued)

OTHER PUBLICATIONS

Diamond, A.S., ed. *Handbook of Imaging Materials*, Marcel Dekker, Inc., NY (1991), pp. 160-163, 1991.*

(Continued)

*Primary Examiner*—Janis L. Dote
(74) *Attorney, Agent, or Firm*—Westerman, Hattori, Daniels & Adrian, LLP.

(57) ABSTRACT

In an imaging color toner employing a photofixing system, a binder resin, which contains, as a principal component, a polyester resin obtained by mixing a first polyester resin having a softening point Tsp of not lower than 120° C. and lower than 170° C. with a second polyester resin having a softening point Tsp of not lower than 80° C. and lower than 110° C. in a weight ratio of 80:20 to 20:80, is used. The color toner is used in an electrophotographic process and other imaging processes.

13 Claims, 2 Drawing Sheets

U.S. PATENT DOCUMENTS

| | | | | |
|---|---|---|---|---|
| 5,756,244 | A | 5/1998 | Omatsu et al. | |
| 5,986,017 | A | 11/1999 | Katagiri et al. | |
| 6,106,986 | A | 8/2000 | Shirai et al. | |
| 6,136,488 | A | 10/2000 | Kushino et al. | |
| 6,183,928 | B1 | 2/2001 | Sata et al. | |
| 6,232,029 | B1 * | 5/2001 | Kushino et al. | 430/137.18 |
| 6,361,914 | B1 * | 3/2002 | Semura et al. | 430/109.4 |

FOREIGN PATENT DOCUMENTS

| | | |
|---|---|---|
| EP | 0 601 235 | 6/1994 |
| EP | 0 892 312 | 1/1999 |
| EP | 0 940 727 | 9/1999 |
| JP | 58-102247 | 6/1983 |
| JP | 58-102248 | 6/1983 |
| JP | 60-57857 | 4/1985 |
| JP | 60-57858 | 4/1985 |
| JP | 60-63545 | 4/1985 |
| JP | 60-63546 | 4/1985 |
| JP | 60-131544 | 7/1985 |
| JP | 60-133460 | 7/1985 |
| JP | 60-230667 | 11/1985 |
| JP | 61-132959 | 6/1986 |
| JP | 4-338973 | 11/1992 |
| JP | 5-107805 | 4/1993 |
| JP | 6-348056 | 12/1994 |
| JP | 7-191492 | 7/1995 |
| JP | 09-90672 | 4/1997 |
| JP | 10-39535 | 2/1998 |
| JP | 11-38666 | 2/1999 |
| JP | 11-65167 | 3/1999 |
| JP | 11-125928 | 5/1999 |
| JP | 11-125929 | 5/1999 |
| JP | 11-125930 | 5/1999 |
| JP | 11-305486 | 11/1999 |
| JP | 11-305486 A | 11/1999 |
| JP | 2000-35689 | 2/2000 |
| JP | 2000-75544 * | 3/2000 |
| JP | 2000-147824 | 5/2000 |
| JP | 3065073 | 5/2000 |
| JP | 2000-155439 | 6/2000 |
| JP | 2000-214626 | 8/2000 |
| JP | 2000-214628 | 8/2000 |
| JP | 2000-305307 | 11/2000 |
| JP | 2001-013734 | 1/2001 |
| JP | 2001-051449 | 2/2001 |
| WO | WO99/13382 | 3/1999 |

OTHER PUBLICATIONS

Japanese Patent Office Machine-Assisted Translation of JP 2000-075544 (pub Mar. 2000).*

USPTO Trademark Electronic Search System (TESS), Ser. No. 71178563.*

Whelan, Tony, Consultant, *Polymer Technology Dictionary*, Chapman & Hall, NY (1994), p. 225.*

Derwent machine-assisted translation of JP 2000-75544 (pub Mar. 2000).*

Y. Nakamura et al.; Abstract of WO 01/06322, dated Jan. 25, 2001.

German Office Action dated Dec. 30, 2004 and English Translation.

* cited by examiner

IMAGING COLOR TONER, COLOR IMAGE FORMING METHOD AND COLOR IMAGE FORMING APPARATUS

BACKGROUND OF THE INVENTION

1. Field of the Invention

The present invention relates to an imaging toner and, more particularly, to an imaging color toner suited for use in electrophotographic and other imaging processes employing a photofixing system. The color toner of the present invention can be used advantageously as a developing agent in various imaging apparatuses employing an electrophotographic system and other systems such as ionographic system, for example, electrophotographic copying machine, electrophotographic facsimile, electrophotographic printer and electrostatic printing machine. The present invention also relates to a color image forming method and a color image forming apparatus, which employ the imaging color toner.

2. Description of Related Art

The electrophotographic system which has been widely used in copying machines, printers and printing machines generally begins by charging the surface of a photoconductive insulator such as a photosensitive drum uniformly with a positive or negative electrostatic charge. After charging uniformly, the electrostatic charge on the insulating material is partially erased by irradiating the photoconductive insulator with image light by various means to thereby form an electrostatic latent image. For example, an electrostatic latent image corresponding to image information can be formed on the photoconductive insulator by erasing the surface charge from particular portions by irradiating with a laser beam. Then a fine powder of developing agent referred to as toner is caused to deposit on the latent image where the electrostatic charge remains on the photoconductive insulator, thereby to visualize the latent image. Last, in order to print the toner image obtained as described above, it is common to electrostatically transfer the image onto a recording medium such as recording paper. For the fixation of the transferred toner image, such methods as a fixing method wherein toner is melted by pressurization, heating or a combination thereof and is then solidified, or a fixing method wherein toner is melted by irradiating with light and is then solidified, have been employed, while much interest is being directed to a method referred to as a photofixing method (also referred to as a flash fixing method) which uses light that is free from adverse effects of pressurization and heating. In the photofixing method, since it is not necessary to apply a pressure to the toner during fixation, the need to bring the toner into contact (pressurization) with a fixing roller or the like is eliminated, and such an advantage is provided as imaging resolution (reproducibility) experiences less degradation in the fixing step. Also because it is not necessary to heat the toner with a heat source, the idle time before printing can be started after turning on the power to preheat the heating medium (fixing roller or the like) to a predetermined temperature is eliminated, so that printing can be started immediately upon turning on the power. Eliminating the need for a high temperature heat source has another advantage that the temperature in the apparatus does not rise too high. It also eliminates such a danger that the recording paper catches fire due to the heat generated by the heat source, even when the recording paper jams in the fixing device due to a system breakdown or other trouble.

However, a color toner has a low efficiency of absorbing light and, when the photofixing method is applied to the fixation of color toner, the fixability is lower than that in the case of fixing a black toner. Thus it has been proposed to improve the fixability by adding an infrared absorbing agent to the color toner, and many patent applications related to this technology have been laid-open as: Japanese Unexamined Patent Publication (Kokai) Nos. 60-63545, 60-63546, 60-57858, 60-57857, 58-102248, 50-102247, 60-131544, 60-133460 and 61-132959, WO99/13382, and Japanese Unexamined Patent Publication (Kokai) Nos. 2000-147824, 7-191492, 2000-155439, 6-348056, 10-39535, 2000-35689, 11-38666, 11-125930, 11-125928, 11-125929 and 11-65167. Technologies disclosed in these publications are attempts at making color rendering and photofixability compatible with each other by adding an infrared absorbing agent to the toner. However, all of the infrared absorbing agents proposed have the problem of inability to achieve satisfactory fixation.

Moreover, the photofixing method has such a problem that the air in the vicinity of toner expands and the toner boils resulting in voids (whiting defects) which are minute printing defects, because the toner is subjected to instantaneous heating by the irradiation with flashlight in the photofixing method. To address this problem, Japanese Unexamined Patent Publication (Kokai) No. 5-107805 discloses an attempt to prevent voids from occurring by controlling the softening point, the glass transition point and the acid value of a binder resin which is used as a major component of toner. However, this method is not effective in preventing voids from occurring when a color toner is used. In the case of a color toner, the binder resin is designed to have lower viscosity than that of the case of black toner for the purpose of smoothing the toner image, which leads to the generation of voids.

Moreover, Japanese Unexamined Patent Publication (Kokai) No. 4-338973 proposes to use a mixture of two kinds of binder resins as the binder resin. However, this method cannot make flash fixability and void resistance compatible with each other.

SUMMARY OF THE INVENTION

Under these circumstances, the present invention has been completed. An object of the present invention is to provide an imaging color toner which allows it to use the photofixing system for fixing images, and is capable of improving both color toner fixability and void resistance in photofixation to the level of a monochromic toner.

Another object of the present invention is to provide a color image forming method which allows it to use the photofixing system for fixing images, and is capable of improving both color toner fixability and void resistance in photofixation to the level of a monochromic toner.

Still another object of the present invention is to provide a color image forming apparatus which allows it to use the photofixing system for fixing images, and is capable of improving both color toner fixability and void resistance in photofixation to the level of a monochromic toner.

These objects and other objects of the present invention will become apparent from the following detailed description.

In one aspect thereof, the present invention resides in an imaging color toner comprising at least a binder resin, a colorant and an infrared absorber, which is used in an electrophotographic process and other processes employing a photofixing system, wherein the binder resin contains, as a principal component, a polyester resin obtained by mixing a first polyester resin with a second polyester resin in a weight ratio of 80:20 to 20:80;

the first polyester resin is a non-linear polyester resin having a softening point Tsp of not lower than 120° C. and lower than 170° C., and also contains 1 to 25 parts by weight of a chloroform-insoluble content as the component; and the second polyester resin is a non-linear polyester resin having a softening point Tsp of not lower than 80° C. and lower than 110° C.

In another aspect thereof, the present invention resides in a method of forming a color image on a recording medium by means of an electrophotographic system which comprises the steps of forming an electrostatic latent image by image exposure, visualizing the electrostatic latent image by development, transferring the visualized image onto the recording medium and fixing the transferred image, wherein a developing agent comprising the color toner of the present invention is used in the step of developing the electrostatic latent image, and a photofixing system is used at a light emission energy density ranging from 1.0 to 6.0 J/cm$^2$ in the step of fixing the transferred image after transferring the image visualized by using the developing agent onto the recording medium.

Furthermore, in still another aspect thereof, the present invention resides in an apparatus for forming a color image on a recording medium by means of an electrophotographic system, comprising an image exposing device for forming an electrostatic latent image, a developing device for visualizing the electrostatic latent image, an image transferring device for transferring the visualized image onto the recording medium, and an image fixing device for fixing the transferred image onto the recording medium, wherein the developing device is loaded with a developing agent containing the color toner of the present invention, and the image fixing device is provided with a photofixing device having a light emission energy density ranging from 1.0 to 6.0 J/cm$^2$.

DESCRIPTION OF THE PREFERRED EMBODIMENTS

Figure 1:
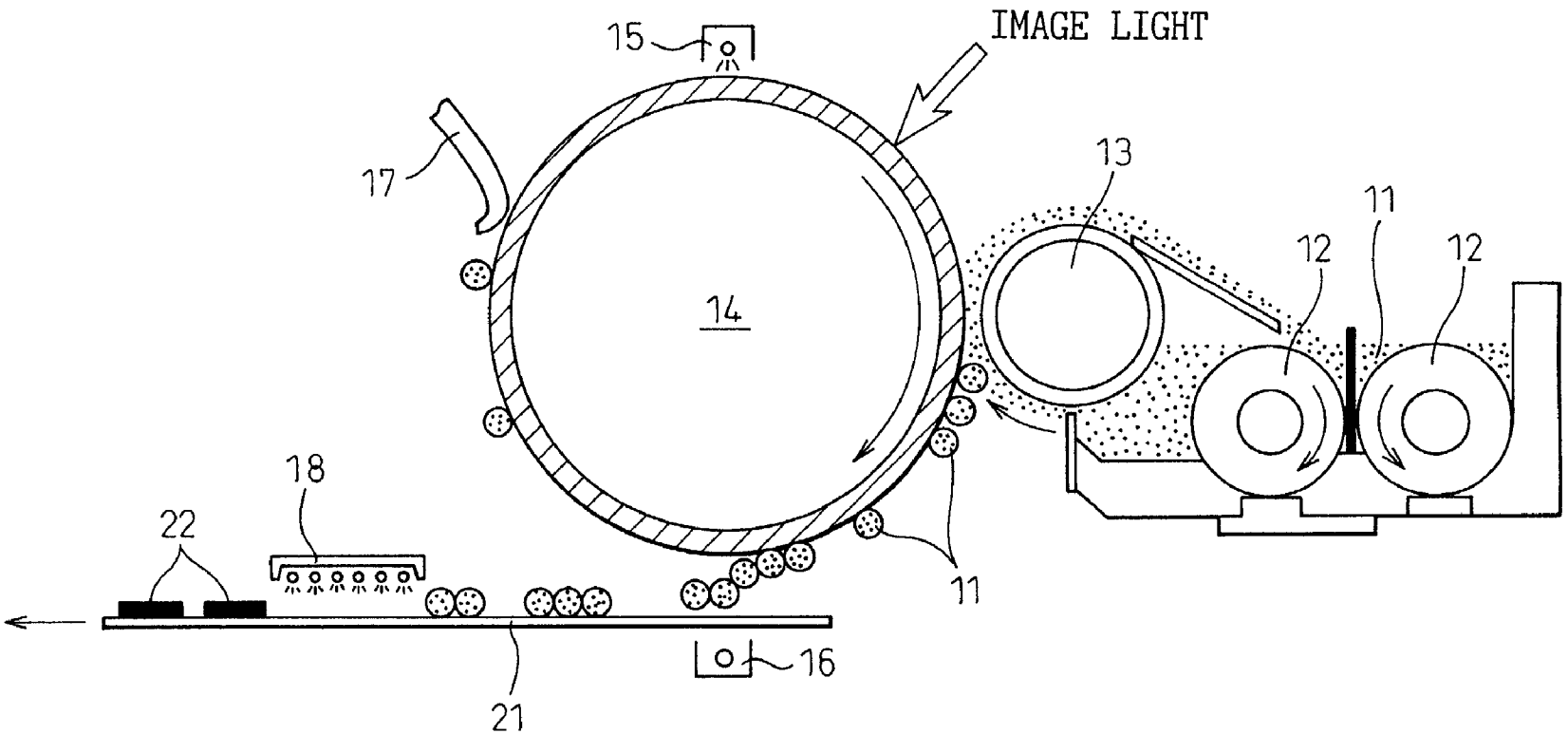
FIG. 1 is a sectional view schematically showing a preferred example of an electrophotographic system for carrying out the image forming method employing a flash fixing system for fixing the toner.

The present invention can be widely applied to an imaging process including an ionographic and electrophotographic process. The present invention will be described hereinafter referring to a particular type of electrophotographic process, however, it should be noted that the present invention is not restricted to this process. There is also no limitation to the developing method used in the electrophotographic and other imaging processes wherein the present invention is applied, and a proper developing method can be freely selected and employed for each application. In other words, according to the present invention, a developing agent most suitable for the developing method to be employed can be prepared and used for the particular application, while satisfying the requirements for the color toner of the present invention. Developing methods which can be employed in the present invention include both two-component developing systems and one-component developing systems that are widely used in the art.

In the two-component developing system, toner particles and carrier particles, such that comprise magnetite, ferrite, iron powder, glass beads or such particles coated with a resin, are brought into contact with each other, with the toner being caused to deposit on the carrier particles by the use of friction charging, and the toner is directed to a portion of latent image thereby to develop the image. In this system, a developing agent is constituted by combining the toner and the carrier. The particle diameter of the carrier is typically within a range from 30 to 500 μm, while 0.5 to 10% by weight of the toner particles is mixed with the carrier particles. Methods employed in this system include a magnetic brush development method.

The one-component developing system is also well known which is a variation of the two-component developing system wherein use of the carrier is eliminated. This method eliminates the need for mechanisms such as for toner concentration control, mixing and stirring because the carrier is not used, and also makes it possible to reduce the apparatus in size. In the one-component developing system, a thin uniform film of toner is formed on a developing roller which is made of metal and an image is developed by attracting the toner to a portion of latent image. The toner particles deposited on the developing roller can be electrostatically charged by friction charging or electrostatic induction. In the case of one-component developing system employing friction charging, for example, a magnetic toner is used in a BMT system and FEED system which involve contact, and nonmagnetic toner is used in a touchdown system which also involves ream contact. Details of the electrophotographic processes and the developing methods employed therein will be left to many publications dealing with the subject of electrophotographic system.

The electrophotographic color toner of the present invention may have a composition similar to that of the color toner used in the electrophotographic system of the prior art. That is, the color toner of the present invention may be generally constituted so as to include at least a binder resin, a colorant and an infrared absorber. While various developing methods are employed in the electrophotographic system as described above, the color toner of the present invention may be either a magnetic toner which has magnetism by itself or a nonmagnetic toner depending on the developing method employed in the intended electrophotographic processes.

As described above, the binder resin used as the base material in the electrophotographic color toner of the present invention has the following essential constituent features:

(1) the binder resin contains, as a principal component, a polyester resin obtained by mixing a first polyester resin with a second polyester resin in a weight ratio of 80:20 to 20:80;

(2) the first polyester resin is a non-linear polyester resin having a softening point Tsp of not lower than 120° C. and lower than 170° C., and also contains 1 to 25 parts by weight of a chloroform-insoluble content as the component; and (3) the second polyester resin is a non-linear polyester resin having a softening point Tsp of not lower than 80° C. and lower than 110° C., thereby making the color toner fixability and void resistance in photofixation compatible with each other, while remarkably improving them.

The first polyester resin is a non-linear polyester resin having a softening point Tsp of not lower than 120° C. and lower than 170° C. When the softening point Tsp of the polyester resin is 170° C. or higher, low energy fixability is lowered. On the other hand, when the softening point Tsp of the polyester resin is 120° C. or lower, the void resistance is lowered.

The second polyester resin is a non-linear polyester resin having a softening point Tsp of not lower than 80° C. and lower than 110° C. When the softening point Tsp of the polyester resin is 110° C. or higher, low energy fixability is lowered. On the other hand, when the softening point Tsp of the polyester resin is 80° C. or lower, the void resistance and blocking resistance are lowered.

Also the first polyester resin contains a chloroform-insoluble content as the component in the amount of not less than 1 part by weight and not more than 25 parts by weight. When the chloroform-insoluble content exceeds 25 parts by weight, low energy fixability is deteriorated. On the other hand, when the chloroform-insoluble content is not more than 1 part by weight, voids are liable to occur.

The mixing ratio of the first polyester resin to the second polyester resin is preferably within a range from 80:20 to 20:80, and more preferably from 65:35 to 35:65. When the proportion of the first polyester resin is larger than the above range, low energy fixability tends to be lowered. On the other hand, when the proportion of the first polyester resin is smaller than the above range, the void resistance tends to be lowered.

It is preferred that an acid value of the first polyester resin is from 20 to 40, an acid value of the second polyester resin is from 5 to 20, and an acid value of the entire polyester resin is from 15 to 35.

In addition to physical properties described above, the first and second polyester resins used as the binder resin preferably have a glass transition point Tg of 45° C. or higher. Consequently, excellent blocking resistance can be obtained.

Furthermore, the first and second polyester resins can have various molecular weights according to the desired effect. Usually, the first polyester resin has a comparatively high molecular weight (weight-average molecular weight) of about $5\times10^3$ to $5\times10^5$ (excluding a gel component). Usually, the second polyester resin has a comparatively low molecular weight of about $1\times10^2$ to $1\times10^4$. Furthermore, the molecular weight of the entire polyester resin is usually within a range from about $1\times10^3$ to $5\times10^4$. When the molecular weight of the polyester resin drastically deviates from the range described above, disadvantages such as poor fixation and occurrence of voids are likely to occur.

In the color toner of the present invention, the first and second polyester resins are mixed in a predetermined weight ratio and the resulting mixture of the polyester resins is used as a principal component of the binder resin. The reason is as follows.

The first polyester resin is a non-linear polyester resin containing a tri- or polyvalent monomer, and also has a comparatively high molecular weight, and thus exhibits excellent void resistance, but is not easily fixed by means of low light emission energy. On the other hand, the second polyester resin is a non-linear polyester resin and can have excellent low energy fixability. However, the second polyester resin is inferior in void resistance because of its low viscosity. The present inventors have taken notice of this fact and found the following. That is, when using the first or second polyester resin alone, drawbacks of each polyester resin drastically appear. However, when using the first and second polyester resins in combination, like the color toner composition of the present invention, the synergy effect of merits of the first and second polyester resins can achieve excellent flash fixability without causing voids. Even if either of polyester resins is used alone, a binder resin capable of simultaneously satisfying the flash fixability and void resistance cannot be synthesized. Furthermore, it is simpler to separately prepare binder resins and then blend them, like the present invention.

The first and second polyester resins can be respectively synthesized from a starting material which is generally used in the preparation of the polyester resin using a conventional procedure. Each polyester resin is not specifically limited, but can be preferably synthesized in the following manner.

Examples of the acid component used in the synthesis of the polyester resin include, but are not limited to, terephthalic acid, isophthalic acid, ortho-phthalic acid, and an anhydride thereof. Terephthalic acid and isophthalic acid are particularly preferred as the acid component. These acid components may be used alone or in combination. Other components can be used in combination with the compounds described above as long as odor does not become a problem during the flash fixation. Examples of a preferred acid component to be used in combination include maleic acid, fumaric acid, citraconic acid, itaconic acid, glutaconic acid, cyclohexanedicarboxylic acid, succinic acid, adipic acid, sebacic acid, azelaic acid, malonic acid. The acid component further includes, for example, alkyl- or alkenylsuccinic acid such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecenylsuccinic acid, or isododecenylsuccinic acid, or an anhydride or a lower alkyl ester of these acids, or the other dihydric carboxylic acid. To crosslink the first polyester resin, a tri- or polyhydric carboxylic acid can be used as the other acid component. Examples of the tri- or polyhydric carboxylic acid include 1,2,4-benzenetricarboxylic acid, 1,3,5-benzenetricarboxylic acid, other polycarboxylic acid, and an anhydride thereof.

The polyester resin used as the binder resin preferably contains at least a polyester resin originating from an alkylene oxide adduct of bisphenol A represented by the following formula (I):

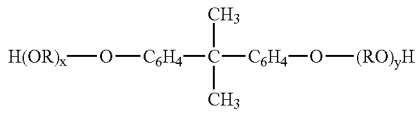

(I)

wherein R represents a substituted or non-substituted alkyl group, preferably an ethylene group or a propylene group, and x and y each represents an integer of 1 or more. In the polyester resin used in the present invention, preferably 80 mol % or more, more preferably 90 mol % or more, and most preferably 95 mol % of an alcohol component is made of the alkylene oxide adduct of bisphenol A. When the amount of the alkylene oxide adduct of bisphenol A is less than 80 mol %, the amount of the monomer, which causes a relatively strong odor, increases and, therefore, it is not preferred.

Examples of the alkylene oxide adduct of bisphenol A, which can be used as a raw material in the synthesis of the polyester resin, include polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxyethylene(2.2)-2,2-bis(4-hydroxyphenyl)propane, polyoxypropylene(2.0)-polyoxyethlene(2.0)-2,2-bis(4-hydroxyphenyl)propane, and polyoxypropylene(6)-2,2-bis(4-hydroxyphenyl)propane. Among these compounds, polyoxypropylene(2.2)-2,2-bis(4-hydroxyphenyl)propane, polyoxyethylene(2.2)-2,2-bis(4-hydroxyphenyl)propane, and polyoxyethylene(2.0)-2,2-bis(4-hydroxyphenyl)propane can be used particularly advantageously. These compounds may be used alone or in combination.

If necessary, other alcohol components can be used in combination with the compounds (alcohol components) described above. Examples the other alcohol compound include other dihydric alcohols, for example, diols (e.g. ethylene glycol, diethylene glycol, triethylene glycol, 1,2-propylene glycol, 1,3-propylene glycol, 1,4-butanediol, neopentyl glycol, 1,4-butenediol, 1,5-pentanediol, and 1,6-hexanediol), and bisphenol A and hydrogenated bisphenol A.

Examples of the tri- or polyhydric alcohol component for synthesis of the first polyester resin include tri- or polyhydric alcohols, for example, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, and trimethylolpropane.

In addition, esterification catalysts used commonly in the field of the synthesis of the resin to promote the reaction in the synthesis of the polyester resin, for example, zinc oxide, stannous oxide, dibutyltin oxide, and dibutylthin dilaurate can be used. The chloroform-insoluble content of the first polyester resin can be controlled to a desired level by preferably adding a tri- or polyhydric acid or alcohol component.

The binder resin may further contain binders used commonly in the field of electrophotography, in addition to the polyester resins described above. Examples of the suitable binder resin, which can be optionally used, include styrene-acrylic resin, epoxy resin, and polyesterpolyol resin.

In the color toner of the present invention, the colorant to be dispersed in the binder resin includes various publicly known dyes and pigments and can be arbitrarily selected and used. Preferred examples of the colorant include, but are not limited to, carbon black, lamp black, iron black, ultramarine blue, nigrosin dye, aniline blue, chalco oil blue, Dupont oil red, quinoline yellow, methylene blue cloride, phthalocyanine blue, phthalocyanine green, hansa yellow, rhodamine 6C lake, chrome yellow, quinacridon, benzidine yellow, malachite green, malachite green hexanoate, oil black, azo oil black, rose bengal, monoazo pigment, disazo pigment, and trisazo pigment. These colorants may be used alone, or used in combination to obtain a desired toner color.

The content of the toner in the colorant can vary according to the desired results, but is usually within a range from 0.1 to 20 parts by weight, and preferably from 0.5 to 10 parts by weight, based on 100 parts by weight of the toner in view of the coloring force of printing, shape retention of the toner and scattering of the toner in order to obtain the best toner characteristics.

As described above, it is essential to contain an infrared absorber, in addition to the binder resin and the colorant, in the electrophotographic color toner of the present invention. The infrared absorbing agent used in the present invention is preferably a compound which shows a light absorption peak at a wavelength ranging from 700 to 1000 nm, though it varies with the wavelength of flashlight used in photofixation. Preferred examples of the infrared absorber capable of showing the light absorption peak include cyanine, anthaquinone, phthalocyanine, naphthalocyanine, polymethine, nickel complex, aminium, diimonium, tin oxide, ytterbium oxide, ytterbium phosphate, and cerium oxide. These infrared absorbers may be used alone or, two or more infrared absorbers may be used in combination.

The total amount of the infrared absorber in the toner can vary widely according to the desired results, but is preferably within a range from 0.01 to 10 parts by weight, and particularly preferably from 0.1 to 6 parts by weight, based on 100 parts by weight of the toner. When the amount of the infrared absorber is smaller than 0.01 parts by weight, the toner can not be fixed even in case of good design. On the other hand, the amount of the infrared absorber is larger than 10 parts by weight, the color of the color toner changes to brown, thus making it impossible to use the color toner.

The electrophotographic color toner of the present invention can arbitrarily contain various conventional additives.

For the purpose of improving the fluidity, the color toner of the present invention can be mixed with white fine inorganic powders. The amount of fine inorganic powders to be mixed with the toner is usually within a range from 0.01 to 5 parts by weight, and preferably from 0.01 to 2.0 parts by weight, based on 100 parts by weight of the toner. Examples of fine inorganic powders include fine powders of silica, titanium oxide, barium titanate, magnesium titanate, calcium titanate, strontium titanate, zinc oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. Among these fine powders, fine silica powders are particularly preferred. Publicly known materials such as silica, titanium, fine resin powders and alumina can be used in combination. As the cleaning active agent, for example, fine powders of metal salts of higher fatty acid, e.g. zinc stearate, etc. and fluorine polymeric substances may be added.

For the purpose of controlling the charge characteristics of the toner, charge controlling agents used commonly in this technical filed can be used. Examples of a suitable charge controlling agent include nigrosine dye, quaternary ammonium salt, amino group-containing polymer, metal-containing azo dye, complex compound of salicylic acid, and phenol compound in case of positive charging. Among these charge controlling agents, quaternary ammonium salt, amino group-containing polymer and complex compound of salicylic acid, which do not exert an adverse influence on a color hue, are useful. In the case of negative charging, azochrome compound, azo zinc compound and calixarene compound are used.

Furthermore, well-known waxes such as polyethylene, polypropylene, ester wax, carnauba, Fisher-Tropsch wax, paraffin wax, and rice wax can be used in combination.

The electrophotographic color toner of the present invention can be prepared according to various procedures using the toner components described above as the starting materials. For example, the color toner of the present invention can be made by employing a known method such as mechanical grinding and classifying process where resin blocks with a colorant or the like dispersed therein are ground and classified, or a polymerization method where a monomer is polymerized while mixing a colorant or the like therein thereby forming fine particles. The color toner of the present invention is preferably made by the mechanical grinding method, advantageously in a procedure as described below.

(1) Mixing of Materials

A binder resin, a colorant, a charge controlling agent, an infrared absorber and the like are weighed and mixed uniformly in a powder mixing machine. For the powder mixing machine, for example, a ball mill or the like can be used. The colorant, the charge controlling agent, etc. are dispersed uniformly in the resin binder.

(2) Melt Kneading

The mixture thus obtained is heated to melt and kneaded, by using a screw extruder, roll mill, kneader or the like. This turns the colorant particles into fine particles and causes the agents to be dispersed uniformly.

(3) Solidification with Cooling

After the completion of the kneading, the kneaded mixture is solidified with cooling.

(4) Grinding

The solidified mixture is first ground into coarse particles with a coarse grinder such as a hammer mill or cutter mill, and then ground into fine powder with a finer grinder such as a jet mill.

(5) Classification

The fine powder made by fine grinding is classified so as to remove particles which are too small and result in lower fluidity of the toner and scatter of the toner, and particles which are too large and result in degradation of picture quality. For the classifier, for example, wind classifier that utilizes a centrifugal force may be used to obtain desired spherical fine particles of the toner.

(6) Surface Treatment

In the last step, the toner particles may be coated with hydrophobic silica or titanium oxide, with another additive added as required, for the purpose of improving the fluidity of the toner. A high speed flow mixer may be used in the surface treatment.

The color image forming method of the present invention includes the steps of forming an electrostatic latent image by image exposure, visualizing the electrostatic latent image by development, transferring the visualized image onto the recording medium and fixing the transferred image, as described previously, while a developing agent containing the color toner of the present invention is used, unlike a conventional method.

Also according to the present invention, in the step of transferring the image which has been visualized by the use of the developing agent onto the recording medium and then fixing the image, the photofixing system is employed to fix the toner. Flashlight can be advantageously used in the photofixation of the transferred toner image. The flashlight may have wavelengths selected from a broad region reaching near infrared as well as the visible region, in accordance with the specifications of the flash fixing device to be used. A xenon lamp can be used to generate the flashlight which efficiently fix the toner. A light intensity of the xenon lamp is preferably within a range from 1.0 to 6.0 J/cm$^2$ in terms of energy density per unit area in a single flash. An energy density of light less than 1.0 J/cm$^2$ is unable to fix the toner and an energy density higher than 6.0 J/cm$^2$ may burn the toner and/or paper. The energy density of light S J/cm$^2$ is given as follows.

$$S=((1/2)\times C\times V^2)/(u\times 1)/(n\times f)$$

where n is the number of lamps, f is the lighting frequency (Hz), V is the input voltage, C is the capacitance of a capacitor (μF), u is the traveling speed of the process (mm/s)and l is the printing width (mm).

Although duration of one flashing cycle of the flashlight may be set within a wide range according to the energy density of flashlight, it is preferably in a range from 500 to 3,000 μs. Too short a flashing cycle of the flashlight may be unable to melt the toner sufficiently to increase the fixing rate. Too long a flashing cycle of the flashlight may, on the other hand, cause overheating of the toner which is fixed on the recording medium.

More specifically, the color image forming method of the present invention may be applied similarly to the image forming method of the prior art, except for the difference described above. By way of a preferable example, formation of an electrostatic latent image by image exposure can be carried out, after uniformly charging the surface of a photoconductive insulator such as a photosensitive drum with positive or negative electrostatic charge, by partially erasing the electrostatic charge deposited on the insulator by irradiating the photoconductive insulator with image light, i.e., light in the pattern of the image, with any of various means, thereby leaving the electrostatic latent image to remain. For example, the surface charge can be erased from particular portions by irradiating with laser beam, so as to form the electrostatic latent image on the photoconductive insulator according to the image information.

Then, the electrostatic latent image thus formed is visualized by development. This can be done by depositing the fine powder of the developing agent, which includes the toner of the present invention, on the latent image portion where the electrostatic charge remains on the photoconductive insulator.

After the developing step, the visualized image is transferred onto the recording medium. This can be generally done by electrostatically transferring the toner image onto the recording medium such as recording paper.

Finally, the toner image transferred in the transfer step described above is melted and fixed on the recording medium by the flash fixing method according to the present invention. An intended duplicate (print or the like) is obtained through the series of processes described above.

The method of forming color images based on electrophotography is well known in this technical field and accordingly a description thereof will be omitted herein.

The color image forming apparatus of the present invention, typically the electrophotographic apparatus, is also well known in this technical field and accordingly a description thereof will be omitted herein. For reference, an example of electrophotographic apparatus which can be advantageously used in the present invention is shown in FIG. 1.

In the electrophotographic apparatus shown in FIG. 1, a developing agent 11 prepared by mixing the color toner of the present invention and a carrier is stirred with a stirring screw 12 so as to effect friction charging. The developing agent 11 which is charged by friction is guided through a predetermined circulation path via a developing roller 13 to reach a photosensitive drum 14. The photosensitive drum 14 may be constituted from a photosensitive material which has photoconductivity, for example organic photosensitive material such as polysilane, phthalocyanine, phthalopolymethine or inorganic photosensitive material such as selenium and amorphous silicon, or an insulating material, depending on the method of forming the latent image. A photosensitive material made of amorphous silicon is particularly preferable in view of long lifetime thereof.

The surface of the photosensitive drum 14 which has received the developing agent 11 transferred thereto is electrostatically charged by a preliminary charger 15 located behind the drum in the rotating direction thereof, while the electrostatic latent image is formed thereon by the image light applied by an exposure device (not shown) according to the image. The preliminary charger 15 may comprise a corona discharging mechanism such as corotron or scorotron, or a contact charging mechanism such as a brush charger. The exposure device may be constituted by using various optical systems as the light source such as laser optical system, LED optical system or liquid crystal optical system. Thus the developing agent 11 which has been charged and transferred to the photosensitive drum 14 is deposited on the drum surface in the area of electrostatic latent image, thereby forming the visualized toner image.

The toner image 11 formed on the photosensitive drum 14 is moved onto the transfer section 16 and is transferred onto a recording medium 21 such as paper, film, etc. The transfer section 16 may have various constitutions depending on the type of force used in the transfer process, such as electrostatic force, mechanical force or viscous force. In case electrostatic force is used, for example, corona transferring device, roll transferring device, belt transferring device or the like can be employed.

The recording medium 21 is guided in the direction of the arrow, so that the toner image is fixed thereon below the flash fixing device 18. The toner image on the recording medium 21 is heated by the flash fixing device 18 so as to melt and penetrate into the recording medium 21 thereby to be fixed. When the fixing step is completed, a fixed image 22 is obtained.

Toner which is left without being used in the transfer step in the toner image 11 on the photosensitive drum 14 is decharged by a decharger (not shown) and removed from the surface of the photosensitive drum 14 by a cleaning device (blade in the case shown in the drawing) 17. The cleaning device may be, besides the blade, magnetic brush cleaner, electrostatic brush cleaner or magnetic roller cleaner.

EXAMPLES

The following Examples further illustrate the present invention in detail. Note, however, that the present invention is not limited to these Examples.

Preparation Examples (1) Preparation of Polyester

An alcohol component, an acid component and a crosslinking component were prepared in accordance with the formulation shown in Table 1 below, and then charged in a 2 liter four-necked flask equipped with a thermometer, a stainless steel stirrer, a glass nitrogen introducing tube and a flow-down type condenser. The content in each flask was reacted in a mantle heater in a nitrogen gas flow under different reaction conditions (220° C. or 240° C.) for a predetermined time and the reaction was continued at the same temperature under reduced pressure of 60 mmHg for two hours. The softening point Tsp, the chloroform-insoluble content and the acid value of the resulting polyester (polyesters 1-1 to 1-5 and polyesters 2-1 to 2-5) were measured according to the following procedure. The results shown in Table 1 below were obtained.

<Softening Point Tsp>

1 $cm^2$ of a sample was melted and flown-out under the conditions of a pore size of a die of 1 mm, a pressure of 20 $kg/cm^2$ and a heating rate of 6° C./minute, and then the temperature corresponding to half of the height from a flow-out starting point to a flow-out end point was measured by using a Koka-type flow tester "CFT-500" (manufactured by SHIMADZU CORPORATION) and taken as a softening point.

<Chloroform-insoluble Content>

This refers to a content which does not penetrate through a filter paper after dissolving the sample in chloroform.

The sample was finely ground and passed through a 40 mesh sieve. The resulting sample powder (5.00 g) was collected and put in a 150 ml container, together with 5.00 g of a filter aid Radiolite (#700). After pouring 100 g of chloroform into the container, the container was placed on a ball mill stand and rotated for five or more hours. The sample was sufficiently dissolved in chloroform.

On the other hand, a filter paper having a diameter of 7 cm (No. 2, weight has already measured) was placed in a pressure filter and 5.00 g of Radiolite was uniformly precoated thereon. After a small amount of chloroform was added, thereby to closely adhere a filter paper to the filter, the content in the container prepared in the previous step was poured into the filter. Furthermore, the container was sufficiently washed with 100 ml of chloroform and chloroform was poured into the filter so that deposits did not remain on the wall of the container. Then, a top cover of the filter was closed and the filtration was carried out. The filtration was carried out under pressure of 4 $kg/cm^2$ or less. After flow-out of chloroform was stopped, 100 ml of chloroform was further added, thereby to wash the residual substance on the filter paper, and the pressure filtration was carried out again. After the completion of the operations described above, the filter paper, the residue on thereon and Radiolite were placed on an aluminum foil, put in a vacuum drier and then dried under the conditions of a temperature of 80 to 100° C. and a pressure of 100 mmHg for 10 hours. The total weight a (g) of the dry solid thus obtained was measured and the chloroform-insoluble content x (% by weight) was determined by the following equation. The chloroform-insoluble content is a high-molecular polymer or a crosslinked polymer component in the polyester.

$$x=[(a\text{–weight of filter paper})-\text{weight of Radiolite}]/(\text{weight of sample})\times 100$$

where the total weight of Radiolite is 10.00 g.

<Acid Value>

This was measured according to the procedure defined in JIS K0070.

TABLE 1

| Polyester | Alcohol component BPA-PO | Alcohol component BPA-EO | Acid component Terephthalic acid | Crosslinking component Trimellitic acid | Catalyst DO | Reaction conditions 220° C. | Reaction conditions 240° C. | Tsp (° C.) | Chloroform-insoluble content (%) | Acid value (KOH mg/g) |
|---|---|---|---|---|---|---|---|---|---|---|
| Polyester 1-1 | 10 mol | | 9 mol | 0.5 mol | 5 g | 3 hours | — | 110 | 0.5 | 10.5 |
| Polyester 1-2 | 10 mol | | 11 mol | 0.5 mol | 5 g | 4 hours | — | 120 | 1 | 21.5 |
| Polyester 1-3 | 10 mol | | 12 mol | 1 mol | 5 g | 4 hours | 3 hours | 135 | 10 | 35.2 |
| Polyester 1-4 | 10 mol | | 13 mol | 1 mol | 5 g | 4 hours | 3 hours | 170 | 25 | 44.2 |
| Polyester 1-5 | 10 mol | | 10 mol | 2 mol | 5 g | 4 hours | 3 hours | 190 | 30 | 56.2 |
| Polyester 2-1 | 5 mol | 5 mol | 10 mol | — | 1 g | 2 hours | | 70 | 0 | 3.5 |
| Polyester 2-2 | 5 mol | 5 mol | 11 mol | — | 2 g | 3 hours | | 80 | 0 | 7.5 |
| Polyester 2-3 | 5 mol | 5 mol | 12 mol | — | 3 g | 3 hours | 2 hours | 100 | 0 | 10.6 |
| Polyester 2-4 | 5 mol | 5 mol | 13 mol | — | 4 g | 3 hours | 3 hours | 110 | 0 | 19.6 |
| Polyester 2-5 | 5 mol | 5 mol | 14 mol | — | 5 g | 4 hours | 4 hours | 120 | 0 | 30.5 |

BPA-PO: polyoxypropylene(2.2)-2,2-bis(4-hydroxyphenyl) propane
BPA-EO: polyoxyethylene(2.2)-2,2-bis(4-hydroxyphenyl) propane
DO: dibutyltin oxide (2) Preparation of Polyester Mixture According to the formulation shown in Table 2 below, the polyesters 1-1 to 1-5 (first polyesters) and the polyesters 2-1 to 2-5 (second polyesters) were dry-mixed by using a mixer. As a result, polyesters A to P were obtained.

TABLE 2

| Polyester | Polyester A | Polyester B | Polyester C | Polyester D | Polyester E | Polyester F | Polyester G | Polyester H |
|---|---|---|---|---|---|---|---|---|
| | Proportion | | | | | | | |
| Polyester 1-1 | | | | | | 50 | | |
| Polyester 1-2 | | | | | | | 50 | |
| Polyester 1-3 | 10 | 20 | 50 | 80 | 90 | | | |
| Polyester 1-4 | | | | | | | | 50 |
| Polyester 1-5 | | | | | | | | |
| Polyester 2-1 | | | | | | | | |
| Polyester 2-2 | | | | | | | | |
| Polyester 2-3 | 90 | 80 | 50 | 20 | 10 | 50 | 50 | 50 |
| Polyester 2-4 | | | | | | | | |
| Polyester 2-5 | | | | | | | | |

unit: parts by weight

| Polyester | Polyester I | Polyester J | Polyester K | Polyester L | Polyester M | Polyester N | Polyester P |
|---|---|---|---|---|---|---|---|
| | Proportion | | | | | | |
| Polyester 1-1 | | | | | | | |
| Polyester 1-2 | | | | | | 20 | |
| Polyester 1-3 | | 50 | 50 | 50 | 50 | | |
| Polyester 1-4 | | | | | | | 80 |
| Polyester 1-5 | 50 | | | | | | |
| Polyester 2-1 | | 50 | | | | | |
| Polyester 2-2 | | | 50 | | | 80 | |
| Polyester 2-3 | 50 | | | | | | |
| Polyester 2-4 | | | | 50 | | | 20 |
| Polyester 2-5 | | | | | 50 | | |

unit: parts by weight (3) Preparation of Carrier

Magnetite particles 60 μm in diameter to be used as the core of carrier particles were coated with an acrylic resin (BR-85 manufactured by Mitsubishi Rayon Co., Ltd.) in a fluidized bed and dried. The amount of the coating material was 2% by weight based on the amount of core material of the carrier. Magnetite carrier coated with the acrylic resin was thus obtained.

(4) Preparation of Color Toner

Color toners having different compositions shown in Table 4 and Table 5 were prepared. The infrared absorbing agents are summarized in Table 3.

Preparation of toner SCY-1

Components of the toner listed in Table 4 were prepared in each amount (parts by weight) described in Table 4. All the components of the material were charged in a Henschel mixer for preliminary mixing. Then the mixture was melted and kneaded in an extruder. After cooling the mixture to solidify, the solid mixture was ground by a hammer mill and then ground into fine powder in a jet mill. The fine powder thus obtained was classified by an air flow classifier, thereby to obtain fine particles colored in yellow having a volume-average particle diameter of 8.5 μm. To the fine particles of toner thus obtained, 0.5 parts by weight of hydrophobic fine silica particles (H3004 manufactured by Clariant Japan Co., Ltd.) were externally added in the Henschel mixer.

Preparation of Toner SCY-2 to SCY-24

In the same manner as in case of the preparation of the toner SCY-1, except that the materials and each amount thereof were changed to those described in Table 4 and Table 5 described below, toners SCY-2 to SCY-24 were prepared. After the colored fine particles having a volume-average particle diameter of 8.5 μm were obtained, external additives were added.

Examples 1 to 20 and Comparative Examples 1 to 9

Toner SCY-1 and toners SCY-2 to SCY-24 prepared as described above were used in printing tests employing the flash fixing system.

Figure 2:
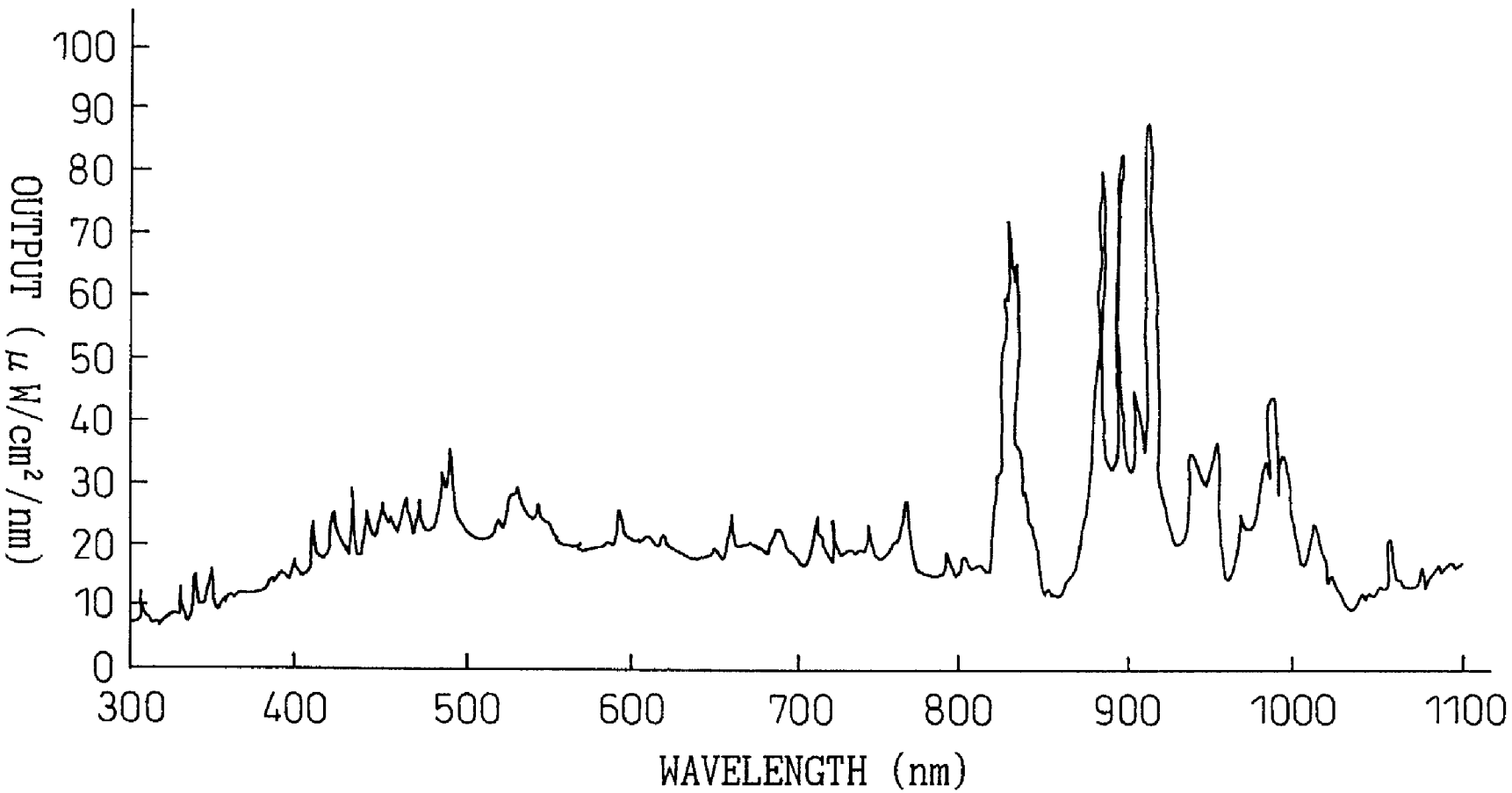
FIG. 2 is a light emission spectrum of a xenon flashlight.

5% by weight of each of the toners described above was mixed with 95% by weight of the carrier prepared as described above, thereby to make a developing agent. The developing agent was set in a high sped printing machine (PS2160 manufactured by Fujitsu Corp.) having a xenon lamp as the fixing light source. Then lines were printed at a process speed of 8,000 lines per m on plain paper used as the recording medium while changing the energy of fixing light as shown in Table 4 and Table 5. Light emitted by the xenon lamp as the spectrum schematically shown in FIG. 2, and the duration of one flash cycle was 1000 μs. Prints thus obtained were evaluated for the following performance:

(1) Fixation % of toner
(2) Fixability
(3) Occurrence of voids
(4) Burning of paper (1) Measurement of Fixation % of Toner The optical density (density of status A) of the lines printed on the paper was measured first. Then after lightly sticking an adhesive tape (SCOTCH™ Mending Tape manufactured by Sumitomo 3M) on the lines printed on the same paper, a cylinder made of steel 100 mm in diameter and 20 mm in width was rolled over the tape in contact therewith, and then the tape was pulled off the paper. Then, the optical density of the lines printed on the paper from which the tape was removed was measured again. Percentage of the optical density after removing the tape to the optical density before removing the tape (100%) was calculated and recorded as the fixation (%) of toner.

(2) Fixability

The fixability of each toner was rated from the fixation (%) of the toner according to the following criteria.

| | |
|---|---|
| Below 70% | X |
| From 70% to below 80% | Δ |
| From 80% to below 90% | ○ |
| 90% or higher | ⊙ |

Fixing rate of 80% or higher means that the toner has practically useful fixability.

(3) Evaluation of Void (Whiting Defect)

Lines printed on the paper were observed with an optical microscope, to visually determine whether whiting defects were generated or not. Print without whiting defects was rated as ○, print having a little whiting defects which can be permitted in practice was rated as Δ, and print having whiting defects which are not practically permissible was rated as X.

(4) Evaluation of Paper Burning

It was visually checked to see whether or not the paper was burned in the print obtained first after continuous printing of million sheets. Print without paper burning was rated as ○, print having slight burning which can be permitted in practice was rated as Δ, and print having paper burning which was not practically permissible was rated as X.

| Material | Product number | Manufacturer | Maximum absorption wavelength (nm) | Molecular absorption coefficient (ε) |
|---|---|---|---|---|
| Anthraquinone | IR-750 | NIPPON KAYAKU CO., LTD. | 755 | 17500 |
| Polymethine | PS102 | NIPPON KAYAKU CO., LTD. | 820 | 167000 |
| Cyanine | FT-10 | NIPPON KAYAKU CO., LTD. | 845 | 235000 |
| Phthalocyanine | IR-3 | NIPPON SHOKUBAI CO., LTD. | 850 | 48000 |
| Nickel complex | SIR-128 | Mitsui Chemicals | 855 | 60000 |
| Naphthalocyanine | YKR-5010 | Yamamoto Chemicals Inc. | 880 | 91200 |
| Aminium | IRG-005 | NIPPON KAYAKU CO., LTD. | 948 | 23900 |

-continued

| Material | Product number | Manufacturer | Maximum absorption wavelength (nm) | Molecular absorption coefficient (ε) |
|---|---|---|---|---|
| Ytterbium oxide | UU-HP | SHIN-ETSU CHEMICAL CO., LTD. | 980 | — |
| Diimonium | IRG-023 | NIPPON KAYAKU CO., LTD. | 1090 | 105000 |
| Tin oxide | TL30S | CATALYSTS&CHEMICALS IND.CO., LTD. | 1095 | — |

TABLE 4

| | | Name | Comp. Example 1 SCY-1 | Example 1 SCY-2 | Example 2 SCY-3 | Example 3 SCY-4 | Comp. Example 2 SCY-5 | Comp. Example 3 SCY-6 | Example 4 SCY-7 | Example 5 SCY-8 |
|---|---|---|---|---|---|---|---|---|---|---|
| Material | Pigment | IRGALITE Yellow WSR (Ciba Speciality) | 5.0 | 5.0 | 5.0 | 5.0 | 5.0 | 5.0 | 5.0 | 5.0 |
| | Binder | Polyester A | 93.0 | | | | | | | |
| | | Polyester B | | 93.0 | | | | | | |
| | | Polyester C | | | 93.0 | | | | | |
| | | Polyester D | | | | 93.0 | | | | |
| | | Polyester E | | | | | 93.0 | | | |
| | | Polyester F | | | | | | 93.0 | | |
| | | Polyester G | | | | | | | 93.0 | |
| | | Polyester H | | | | | | | | 93.0 |
| | | Polyester I | | | | | | | | |
| | | Polyester J | | | | | | | | |
| | | Polyester K | | | | | | | | |
| | | Polyester L | | | | | | | | |
| | | Polyester M | | | | | | | | |
| | | Polyester N | | | | | | | | |
| | | Polyester P | | | | | | | | |
| | Charge controlling agent | CCA-100 (CHUO GOUSEI KAGAKU CO., LTD.) | 1.0 | 1.0 | 1.0 | 1.0 | 1.0 | 1.0 | 1.0 | 1.0 |
| | Infrared absorber | IR-750 | | | | | | | | |
| | | PS102 | | | | | | | | |
| | | FT-10 | | | | | | | | |
| | | IR-3 | | | | | | | | |
| | | SIR-128 | | | | | | | | |
| | | YKR-5010 | 0.5 | 0.5 | 0.5 | 0.5 | 0.5 | 0.5 | 0.5 | 0.5 |
| | | IRG-005 | | | | | | | | |
| | | UU-HP | | | | | | | | |
| | | IRG-023 | | | | | | | | |
| | | TL30S | | | | | | | | |
| | Wax | NP105 (Mitsui Chemicals) | 0.5 | 0.5 | 0.5 | 0.5 | 0.5 | 0.5 | 0.5 | 0.5 |
| | External additive | H3004 (Clariant) | 0.5 | 0.5 | 0.5 | 0.5 | 0.5 | 0.5 | 0.5 | 0.5 |
| Evaluation | | Fixation (%) | 95.0 | 92.0 | 90.0 | 85.0 | 62.0 | 93.0 | 91.0 | 85.0 |
| | | Judgment of fixability | ◎ | ◎ | ◎ | ○ | X | ○ | ○ | ○ |
| | | Occurrence of voids | X | ○ | ○ | ○ | ○ | X | ○ | ○ |
| | | Paper burning | ○ | ○ | ○ | ○ | ○ | ○ | ○ | ○ |
| | | Photofixing energy (J/cm$^2$) | 2.2 | 2.2 | 2.2 | 2.2 | 2.2 | 2.2 | 2.2 | 2.2 |

| | | Name | Comp. Example 4 SCY-9 | Comp. Example 5 SCY-10 | Example 6 SCY-11 | Example 7 SCY-12 | Comp. Example 6 SCY-13 | Example 8 SCY-14 | Example 9 SCY-15 |
|---|---|---|---|---|---|---|---|---|---|
| Material | Pigment | IRGALITE Yellow WSR (Ciba Speciality) | 5.0 | 5.0 | 5.0 | 5.0 | 6.0 | 7.0 | 8.0 |
| | Binder | Polyester A | | | | | | | |
| | | Polyester B | | | | | | | |
| | | Polyester C | | | | | | | |
| | | Polyester D | | | | | | | |
| | | Polyester E | | | | | | | |
| | | Polyester F | | | | | | | |
| | | Polyester G | | | | | | | |
| | | Polyester H | | | | | | | |
| | | Polyester I | 93.0 | | | | | | |
| | | Polyester J | | 93.0 | | | | | |
| | | Polyester K | | | 93.0 | | | | |
| | | Polyester L | | | | 93.0 | | | |
| | | Polyester M | | | | | 93.0 | | |
| | | Polyester N | | | | | | 93.0 | |
| | | Polyester P | | | | | | | 93.0 |

TABLE 4-continued

| | | | | | | | | | |
|---|---|---|---|---|---|---|---|---|---|
| | Charge controlling agent | CCA-100 (CHUO GOUSEI KAGAKU CO., LTD.) | 1.0 | 1.0 | 1.0 | 1.0 | 1.0 | 1.0 | 1.0 |
| | Infrared absorber | IR-750 | | | | | | | |
| | | PS102 | | | | | | | |
| | | FT-10 | | | | | | | |
| | | IR-3 | | | | | | | |
| | | SIR-128 | | | | | | | |
| | | YKR-5010 | 0.5 | 0.5 | 0.5 | 0.5 | 0.5 | 0.5 | 0.5 |
| | | IRG-005 | | | | | | | |
| | | UU-HP | | | | | | | |
| | | IRG-023 | | | | | | | |
| | | TL30S | | | | | | | |
| | Wax | NP105 (Mitsui Chemicals) | 0.5 | 0.5 | 0.5 | 0.5 | 0.5 | 0.5 | 0.5 |
| | External additive | H3004 (Clariant) | 0.5 | 0.5 | 0.5 | 0.5 | 0.5 | 0.5 | 0.5 |
| Evaluation | | Fixation (%) | 65.0 | 95.0 | 92.0 | 81.0 | 55.0 | 98.0 | 800 |
| | | Judgment of fixability | X | ◎ | ◎ | ○ | X | ◎ | ○ |
| | | Occurrence of voids | ○ | X | ○ | ○ | ○ | Δ | ○ |
| | | Paper burning | ○ | ○ | ○ | ○ | ○ | ○ | ○ |
| | | Photofixing energy (J/cm$^2$) | 2.2 | 2.2 | 2.2 | 2.2 | 2.2 | 2.2 | 2.2 |

TABLE 5

| | | Name | Example 10 SCY-16 | Example 11 SCY-17 | Example 12 SCY-18 | Example 13 SCY-19 | Example 14 SCY-20 | Example 15 SCY-21 | Example 16 SCY-22 | Example 17 SCY-23 |
|---|---|---|---|---|---|---|---|---|---|---|
| Material | Pigment | IRGALITE Yellow WSR (Ciba Speciality) | 5.0 | 5.0 | 5.0 | 5.0 | 5.0 | 5.0 | 5.0 | 5.0 |
| | Binder | Polyester C | 93.0 | 93.0 | 93.0 | 93.0 | 93.0 | 93.0 | 93.0 | 93.0 |
| | CCA | CCA-100 (CHUO GOUSEI KAGAKU CO., LTD.) | 1.0 | 1.0 | 1.0 | 1.0 | 1.0 | 1.0 | 1.0 | 1.0 |
| | Infrared absorber | IR-750 | 0.50 | | | | | | | |
| | | PS102 | | 0.50 | | | | | | |
| | | FT-10 | | | 0.50 | | | | | |
| | | IR-3 | | | | 0.50 | | | | |
| | | SIR-128 | | | | | 0.50 | | | |
| | | YKR-5010 | | | | | | | | |
| | | IRG-005 | | | | | | 0.5 | | |
| | | UU-HP | | | | | | | 0.5 | |
| | | IRG-023 | | | | | | | | 0.5 |
| | | TL30S | | | | | | | | |
| | Wax | NP105 (Mitsui Chemicals) | 0.5 | 0.5 | 0.5 | 0.5 | 0.5 | 0.5 | 0.5 | 0.5 |
| | External additive | H3004 (Clariant) | 0.5 | 0.5 | 0.5 | 0.5 | 0.5 | 0.5 | 0.5 | 0.5 |
| Evaluation | | Fixation (%) | 84.0 | 85.0 | 86.0 | 82.0 | 81.0 | 82.0 | 83.0 | 82.0 |
| | | Judgment of fixability | ○ | ○ | ○ | ○ | ○ | ○ | ○ | ○ |
| | | Occurrence of voids | ○ | ○ | ○ | ○ | ○ | ○ | ○ | ○ |
| | | Paper burning | ○ | ○ | ○ | ○ | ○ | ○ | ○ | ○ |
| | | Photofixing energy (J/cm$^2$) | 2.2 | 2.2 | 2.2 | 2.2 | 2.2 | 2.2 | 2.2 | 2.2 |

| | | Name | Example 18 SCY-24 | Comp. Example 7 SCY-3 | Example 19 SCY-3 | Example 20 SCY-3 | Example 21 SCY-3 | Comp. Example 8 SCY-3 | Comp. Example 9 SCY-3 |
|---|---|---|---|---|---|---|---|---|---|
| Material | Pigment | IRGALITE Yellow WSR (Ciba Speciality) | 5.0 | 5.0 | 5.0 | 5.0 | 5.0 | 5.0 | 5.0 |
| | Binder | Polyester C | 93.0 | 93.0 | 93.0 | 93.0 | 93.0 | 93.0 | 93.5 |
| | CCA | CCA-100 (CHUO GOUSEI KAGAKU CO., LTD.) | 1.0 | 1.0 | 1.0 | 1.0 | 1.0 | 1.0 | 1.0 |
| | Infrared absorber | IR-750 | | | | | | | |
| | | PS102 | | | | | | | |
| | | FT-10 | | | | | | | |
| | | IR-3 | | | | | | | |
| | | SIR-128 | | | | | | | |
| | | YKR-5010 | | 0.50 | 0.50 | 0.50 | 0.50 | 0.50 | |
| | | IRG-005 | | | | | | | |
| | | UU-HP | | | | | | | |
| | | IRG-023 | | | | | | | |
| | | TL30S | 5.0 | | | | | | |
| | Wax | NP105 (Mitsui Chemicals) | 0.5 | 0.5 | 0.5 | 0.5 | 0.5 | 0.5 | 0.5 |

TABLE 5-continued

| | | | | | | | | |
|---|---|---|---|---|---|---|---|---|
| External additive | H3004 (Clariant) | 0.5 | 0.5 | 0.5 | 0.5 | 0.5 | 0.5 | 0.5 |
| Evaluation | Fixation (%) | 80.0 | 65.0 | 85.0 | 98.0 | 99.0 | 100.0 | 15.0 |
| | Judgment of fixability | ○ | X | ○ | ◎ | ◎ | ◎ | X |
| | Occurrence of voids | ○ | ○ | ○ | ○ | Δ | X | ○ |
| | Paper burning | ○ | ○ | ○ | ○ | Δ | X | ○ |
| | Photofixing energy ($J/cm^2$) | 2.2 | 0.5 | 1.0 | 3.0 | 6.0 | 7.0 | 2.2 |

According to the present invention, as described above, there can be provided an electrophotographic color toner which allows it to use a photofixing system for fixing images, and is capable of improving both color toner fixability and void resistance in photofixation to the level of a monochromic toner.

Also according to the present invention, there can be provided a color image forming method and an color image forming apparatus, which allow it to effectively use the color toner of the present invention and fully achieve the effects thereof.

The invention claimed is:

1. An imaging color toner comprising at least a binder resin, a colorant and an infrared absorber, wherein the binder resin contains, as a principal component, a polyester resin obtained by mixing a first polyester resin with a second polyester resin in a weight ratio of 80:20 to 20:80;

the first polyester resin is a crosslinked polyester resin having a softening point Tsp of not lower than 120° C. and lower than 170° C., and also contains 1 to 25 parts by weight of a chloroform-insoluble content as the component; and the second polyester resin is a non-crosslinked polyester resin having a softening point Tsp of not lower than 80° C. and lower than 110° C., wherein the toner is capable of being photofixed; and wherein an acid value of the first polyester resin is from 20 to 40, an acid value of the second polyester resin is from 5 to 20, and an acid value of the entire polyester resin is from 15 to 35.

2. The imaging color toner according to claim 1, wherein the infrared absorber is a compound which shows a light absorption peak at a wavelength ranging from 700 to 1000 nm.

3. The imaging color toner according to claim 2, wherein the infrared absorber is at least one compound selected from the group consisting of cyanine, anthaquinone, phthalocyanine, naphthalocyanine, polymethine, nickel complex, aminium, diimonium, tin oxide, ytterbium oxide, ytterbium phosphate, and cerium oxide.

4. The imaging color toner according to claim 1, wherein the first polyester resin is a polyester resin originating from an alkylene oxide adduct of bisphenol A represented by the following formula (I):

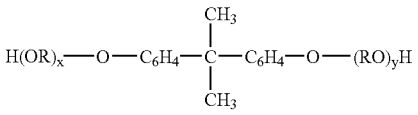

(I)

wherein R represents a substituted or unsubstituted alkyl group, and x and y each represents an integer of 1 or more.

5. The imaging color toner according to claim 1, wherein said second polyester resin is a polymerization product of polyoxypropylene (2.2)-2, 2-bis (4-hydroxyphenyl) propane, polyoxyethylene (2.2)-2, 2-bis (4-hydroxyphenyl) propane and terephthalic acid in the absence of a crosslinking component.

6. A method of forming a color image on a recording medium which comprises the steps of forming an electrostatic latent image by image exposure, visualizing the electrostatic latent image by development, transferring the visualized image onto the recording medium and fixing the transferred image, wherein a developing agent comprising a color toner, which comprises at least a binder resin, a colorant and an infrared absorber, is used in the step of developing the electrostatic latent image, the binder resin containing, as a principal component, a polyester resin obtained by mixing a first polyester resin with a second polyester resin in a weight ratio of 80:20 to 20:80;

the first polyester resin being a crosslinked polyester resin having a softening point Tsp of not lower than 120° C. and lower than 170° C., and also containing 1 to 25 parts by weight of a chloroform insoluble content as the component; and the second polyester resin being a polyester resin having a softening point Tsp of not lower than 80° C. and lower than 110° C., said second polyester resin being a polymerization product of polyoxypropylene (2.2)-2, 2-bis (4-hydroxyphenyl) propane, polyoxyethylene (2.2)-2, 2-bis (4-hydroxyphenyl) propane and terephthalic acid in the absence of a crosslinking component; and a photofixing system is used at a light emission energy density ranging from 1.0 to 6.0 $J/cm^2$ in the step of fixing the transferred image after transferring the image visualized by using the developing agent onto the recording medium;

wherein an acid value of the first polyester resin is from 20 to 40, an acid value of the second polyester resin is from 5 to 20, and an acid value of the entire polyester resin is from 15 to 35.

7. The color image forming method according to claim 6, wherein the infrared absorber is a compound which shows a light absorption peak at a wavelength ranging from 700 to 1000 nm.

8. The color image forming method according to claim 7, wherein the infrared absorber is at least one compound selected from the group consisting of cyanine, anthaquinone, phthalocyanine, naphthalocyanine, naphthalocyanine, polymethine, nickel complex, aminium, diimonium, tin oxide, ytterbium oxide, ytterbium phosphate, and cerium oxide.

9. An apparatus for forming a color image on a recording medium comprising an image exposing device for forming an electrostatic latent image, a developing device for visualizing the electrostatic latent image, an image transferring device for transferring the visualized image onto the recording medium, and an imaging fixing device for fixing the transferred image onto the recording medium, wherein the developing device is loaded with a developing agent containing a color toner, which comprises at least a binder resin, a colorant and an infrared absorber, the binder resin containing, as a principal component, a polyester resin obtained by mixing a first polyester resin with a second polyester resin in a weight ratio of 80:20 to 20:80;

the first polyester resin being a crosslinked polyester resin having a softening point Tsp of not lower than 120° C. and lower than 170° C., and also containing 1 to 25 parts by weight of a chloroform-insoluble content as the component; and the second polyester resin being a polyester resin having a softening point Tsp of not lower than 80° C. and lower than 110° C., said second polyester resin being a polymerization product of polyoxypropylene (2.2)-2, 2-bis (4-hydroxyphenyl) propane, polyoxyethylene (2.2)-2, 2-bis (4-hydroxyphenyl) propane and terephthalic acid in the absence of a crosslinking component; and the image fixing device being provided with a photofixing device having a light emission energy density ranging from 1.0 to 6.0 J/cm$^2$;

wherein an acid value of the first polyester resin is from 20 to 40, an acid value of the second polyester resin is from 5 to 20, and an acid value of the entire polyester resin is from 15 to 35.

10. The color image forming apparatus according to claim 9, wherein the infrared absorber is a compound which shows a light absorption peak at a wavelength ranging from 700 to 1000 nm.

11. The color image forming apparatus according to claim 10, wherein the infrared absorber is at least one compound selected from the group consisting of cyanine, anthaquinone, phthalocyanine, naphthalocyanine, polymethine, nickel complex, aminium, diimonium, tin oxide, ytterbium oxide, ytterbium phosphate, and cerium oxide.

12. An imaging color toner comprising at least a binder resin, a colorant and an infrared absorber, wherein;

the binder resin contains, as a principal component, a polyester resin obtained by mixing a first polyester resin with a second polyester resin in a weight ratio of 80:20 to 20:80;

the first polyester resin is a crosslinked polyester resin having a softening point Tsp of not lower than 120° C. and lower than 170° C., and also contains 1 to 25 parts by weight of a chloroform-insoluble content as the component; and the second polyester resin is a linear polyester resin having a softening point Tsp of not lower than 80° C. and lower than 110° C., wherein the toner is capable of being photofixed;

and wherein an acid value of the first polyester resin is from 20 to 40, an acid value of the second polyester resin is from 5 to 20, and an acid value of the entire polyester resin is from 15 to 35.

13. The imaging color toner according to claim 12, wherein said second polyester resin is a polymerization product of polyoxypropylene (2.2)-2, 2-bis (4-hydroxyphenyl) propane, polyoxyethylene (2.2)-2,2-bis (4-hydroxyphenyl) propane and terephthalic acid in the absence of a crosslinking component.

* * * * *